US010060378B2

(12) United States Patent
Smolarek et al.

(10) Patent No.: US 10,060,378 B2
(45) Date of Patent: Aug. 28, 2018

(54) INDUCTIVE POSITIVE CRANKCASE VENTILATION VALVE POSITION SENSOR

(71) Applicant: DENSO International America, Inc., Southfield, MI (US)

(72) Inventors: Dallas J. Smolarek, Northville, MI (US); Blaise D. Friery, Farmington Hills, MI (US)

(73) Assignee: DENSO International America, Inc., Southfield, MI (US)

( * ) Notice: Subject to any disclaimer, the term of this patent is extended or adjusted under 35 U.S.C. 154(b) by 48 days.

(21) Appl. No.: 15/161,162

(22) Filed: May 20, 2016

(65) Prior Publication Data

US 2017/0335786 A1 Nov. 23, 2017

(51) Int. Cl.

*F02D 41/24* (2006.01)
*F01M 13/00* (2006.01)
*F02M 25/06* (2016.01)

(52) U.S. Cl.

CPC ..... *F02D 41/2464* (2013.01); *F01M 13/0011* (2013.01); *F02M 25/06* (2013.01); *F02D 2200/0406* (2013.01); *F02D 2250/08* (2013.01)

(58) Field of Classification Search

CPC ..... F02D 2041/1409; F02D 2041/141; F02D 2041/1433; F02D 2041/2051; F02D 2041/281; F02D 2041/286; F01M 13/00; F01M 2013/0022; F01M 13/023; F01M 2013/0077

See application file for complete search history.

(56) References Cited

U.S. PATENT DOCUMENTS 4,175,602 A * 11/1979 Cavalaris ..... A45C 3/00 141/390
4,185,602 A * 1/1980 Minks ..... F02P 7/067 123/146.5 A
4,280,471 A * 7/1981 Masaki ..... F02D 41/0077 123/339.25

(Continued)

FOREIGN PATENT DOCUMENTS

JP 2010/196594 A 9/2010
JP 2012/246801 A 12/2012

OTHER PUBLICATIONS

Machine translation of JP2010196594A.*

*Primary Examiner* — Long T Tran
(74) *Attorney, Agent, or Firm* — Harness, Dickey & Pierce, P.L.C.

(57) ABSTRACT

A sensor circuit for a positive crankcase ventilation (PCV) valve includes an electrical source, a measuring circuit, a position calculator, and a transmitter. The electrical source is configured to apply an electrical bias across a spring of the PCV valve. The electrical bias is applied between a first end of the spring and an opposite end of the spring. The measuring circuit is configured to measure a value of an electrical parameter of the spring while the electrical bias is applied. The electrical parameter indicates at least one of a voltage across the spring and a current through the spring. The position calculator is configured to calculate an inductance of the spring based on the value of the electrical parameter and calculate a position of the PCV valve based on the inductance. The transmitter is configured to output a signal that indicates the position of the PCV valve.

20 Claims, 8 Drawing Sheets

(56) References Cited

U.S. PATENT DOCUMENTS

| | | | | |
|---|---|---|---|---|
| 5,791,318 | A * | 8/1998 | Schulz | F02M 25/0836 123/458 |
| 6,516,765 | B1 | 2/2003 | Becker, Jr. | |
| 6,553,840 | B2 | 4/2003 | Fournier et al. | |
| 7,420,362 | B2 * | 9/2008 | Gurich | F02M 59/44 324/207.19 |
| 8,836,325 | B2 | 9/2014 | Prost et al. | |
| 2007/0152659 | A1 * | 7/2007 | Gurich | F02M 59/44 324/207.24 |
| 2007/0242408 | A1 * | 10/2007 | Bergstrom | F01L 9/04 361/192 |
| 2009/0014672 | A1 * | 1/2009 | Schiemann | F01L 9/02 251/129.01 |
| 2010/0076664 | A1 * | 3/2010 | Monros | F01M 13/00 701/102 |
| 2011/0168123 | A1 | 7/2011 | Kerr | |
| 2014/0096754 | A1 * | 4/2014 | Monros | F01M 13/0011 123/574 |

* cited by examiner

INDUCTIVE POSITIVE CRANKCASE VENTILATION VALVE POSITION SENSOR

FIELD

The present disclosure relates to emission controls circuitry in a motor vehicle, and more particularly to systems and methods of determining position of a positive crankcase ventilation (PCV) valve.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Positive crankcase ventilation (PCV) valves recirculate blow-by gas or "waste" gas that is in the crankcase back to the intake manifold. This allows the blow-by gas to combust again with a fresh supply of air and fuel once recirculated to the intake manifold, which generally decreases emissions.

Due to changes in federal regulations, fault detection methods and systems to diagnose malfunctions and leaks will be required for PCV valves. Currently, many PCV valve systems use a controller to prescribe the position of the valve. There are only a few passive valves where a sensor determines the position of the valve.

SUMMARY

A sensor circuit for a positive crankcase ventilation (PCV) valve includes an electrical source, a measuring circuit, a position calculator, and a transmitter. The electrical source is configured to apply an electrical bias across a spring of the PCV valve. The electrical bias is applied between a first end of the spring and an opposite end of the spring. The measuring circuit is configured to measure a value of an electrical parameter of the spring while the electrical bias is applied. The electrical parameter indicates at least one of a voltage across the spring and a current through the spring. The position calculator is configured to calculate an inductance of the spring based on the value of the electrical parameter and calculate a position of the PCV valve based on the inductance. The transmitter is configured to output a signal that indicates the position of the PCV valve.

Further areas of applicability of the present disclosure will become apparent from the detailed description, the claims, and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings.

In the drawings, reference numbers may be reused to identify similar and/or identical elements.

DETAILED DESCRIPTION

The present disclosure describes a positive crankcase ventilation (PCV) valve position sensor and operation method. A PCV valve recirculates blow-by gases from the crankcase of an engine to an intake manifold. In some passive PCV valves, a spring of the PCV valve biases the PCV valve into a closed position, preventing the recirculation of blow-by gases. For example, the spring may press a flange against an opening. When the difference between the vacuum of the intake manifold and the pressure of the crankcase of the engine overcomes the force of the spring, the PCV valve begins to open, allowing blow-by gases to vent from the crankcase to the intake manifold.

As the difference between the vacuum of the intake manifold and the pressure of the crankcase increases, the PCV valve opens further. Depending on how the spring is arranged, opening the valve may cause the spring to be compressed or extended. For simplicity, the disclosure below will describe the arrangement where a coil spring compresses as the PCV valve opens. As the coil spring compresses, the number of turns per unit of length increases, which increases the inductance of the coil spring. By measuring this inductance, the length of the spring can be calculated, which in turn indicates the position of the valve. The position of the PCV valve can then be determined using a component (the spring) already present in the PCV valve without the need to add a discrete sensor.

One method of measuring the inductance of an inductor is to connect a resistor in series with the inductor. An electrical source (a current source or a voltage source) with a controllable frequency is applied across the series connection of the resistor and inductor, and the voltage across the inductor is measured. Equivalently, the voltage across the resistor could be measured. The frequency of the electrical source is varied until the voltage across the resistor is equal to the voltage across the inductor. The inductance can then be calculated, as described below, from the resistance and the frequency.

Figure 1:
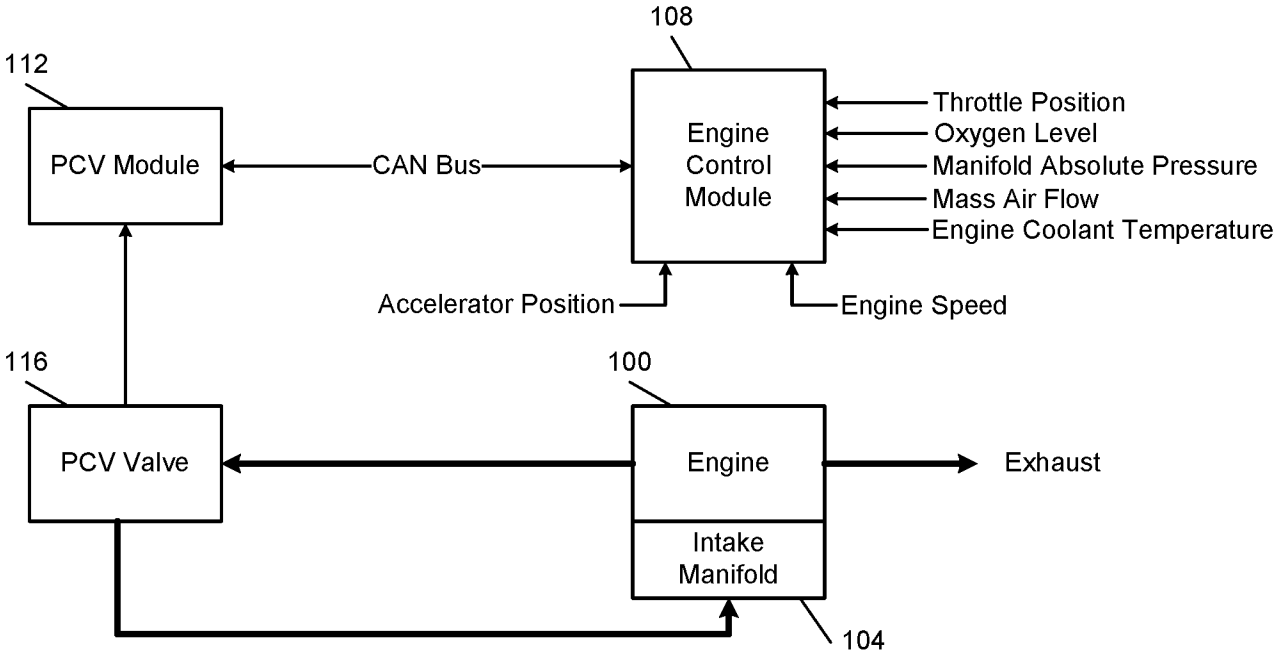
FIG. 1 is a functional block diagram of a PCV module integrated within a vehicle.

In FIG. 1, a functional block diagram of a PCV module integrated with a vehicle is presented. An engine 100 includes a crankcase (not shown) that may contain blow-by gases from cylinders of the engine 100. A PCV valve 116 operates to selectively recirculate blow-by gases from the crankcase to an intake manifold 104 to combust again in the engine 100 with a new supply of air and fuel.

The engine 100 is controlled by an engine control module (ECM) 108, which communicates with sensors (not shown) throughout the engine 100. These sensors may include, but are not limited to: an engine speed sensor, a throttle position sensor (TPS), an oxygen sensor, an air to fuel ratio (AFR) sensor, a manifold absolute pressure (MAP) sensor, an accelerator position sensor, a mass air flow (MAF) sensor, engine coolant temperature sensor, etc.

A PCV module 112 measures a position of the PCV valve 116 and communicates this information to the ECM 108, such as through a controller area network (CAN) bus. In some implementations, each measurement made by the PCV module 112 may be performed in response to an explicit request from the ECM 108. In other implementations, the PCV module 112 performs at least some measurements autonomously, such as at predetermined time intervals. As described above, the PCV valve 116 selectively allows gases from the crankcase of the engine to be recirculated to the intake manifold 104.

The PCV valve 116 may be a passive valve that responds to pressure differences between the crankcase and the intake manifold 104. In other implementations, the PCV valve 116 may be an active valve, controlled electrically or using vacuum. Even as an active valve, the PCV valve 116 may still include a spring, which may return the PCV valve 116 to a closed position when the electrical or vacuum actuator is no longer motivating the PCV valve 116 to an open position. Conversely, the spring may return the PCV valve 116 to an open position when the electrical or vacuum actuator is no longer motivating the PCV valve 116 to a closed position. The principles of the present disclosure may be used to verify that the PCV valve 116 is responding as expected to the applied control, which may detect conditions such as a stuck or sticking condition of the PCV valve 116.

Figure 2B:
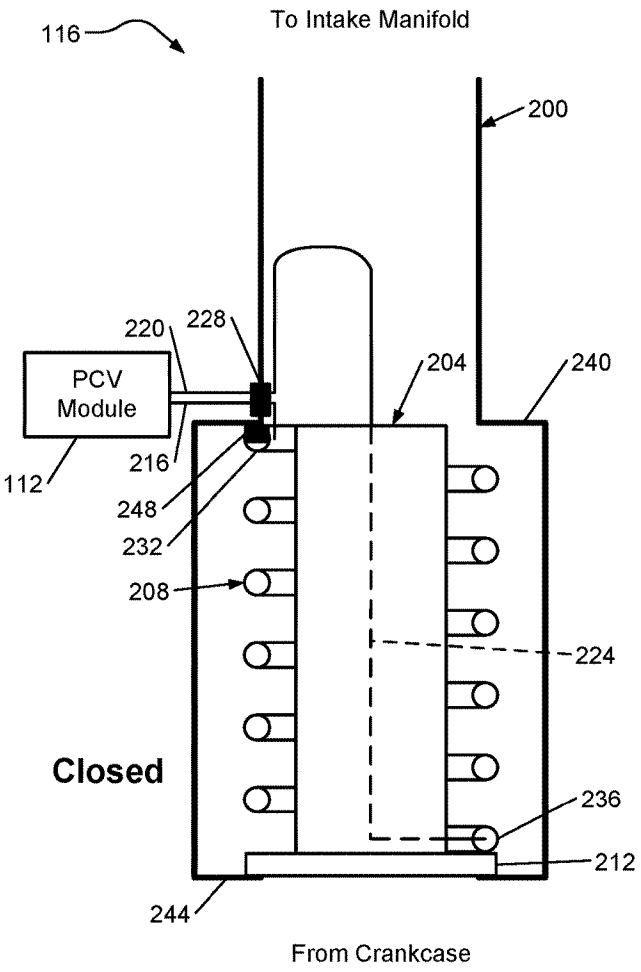
FIG. 2B is a cross-sectional view illustrating the PCV valve in a closed position.
Figure 2A:
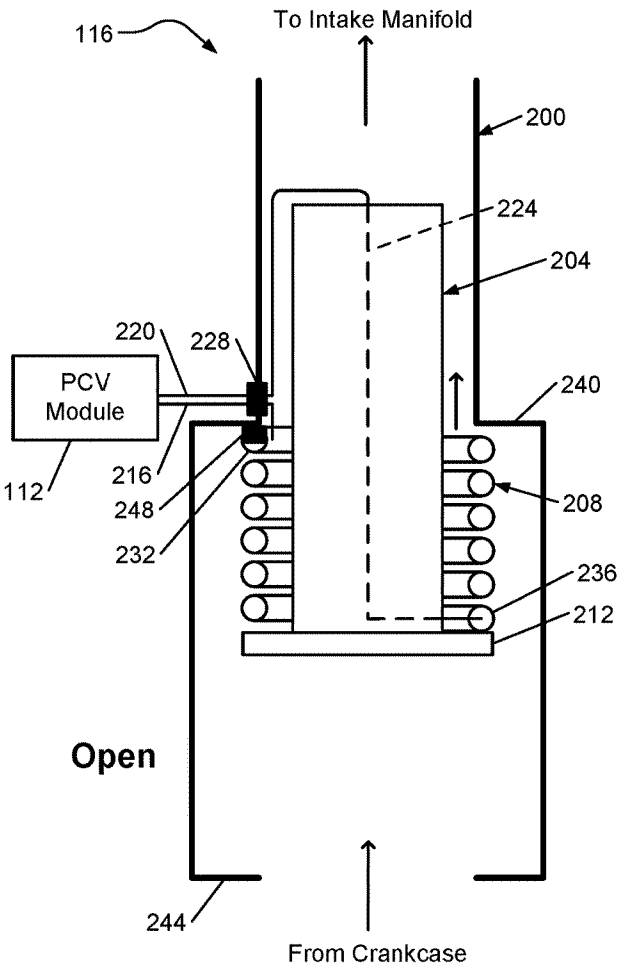
FIG. 2A is a cross-sectional view illustrating a PCV valve in an open position.

In FIG. 2A, a cross-sectional view illustrates an example implementation of the PCV valve 116 in an open position. The PCV valve 116 includes a housing 200, a plunger 204, and a spring 208. In the implementation shown, the spring 208 is disposed concentrically around the plunger 204. A shoulder 240 of the housing creates a seat for a first end of the spring 208, preventing the spring 208 from moving toward the intake manifold 104, while the plunger 204 is able to continue upward past the shoulder 240.

An end 244 of the housing 200 defines an opening to the crankcase of the engine 100. An end of the plunger 204 closest to the end 244 of the housing 200 includes a flange 212. The flange 212 creates a seat for a second end 236 of the spring, keeping the spring 208 between the shoulder 240 of the housing 200 and the flange 212.

The opening to the crankcase is smaller than the flange 212. Therefore, when the spring 208 is extended and the flange 212 rests on the end 244 of the housing, the PCV valve 116 is closed. As the pressure difference between the crankcase and the intake manifold 104 overcomes the force of the spring 208, the plunger 204 moves up to the position shown in FIG. 2A, compressing the spring 208 between the shoulder 240 of the housing and the flange 212. As the plunger 204 moves toward the intake manifold 104, the flange 212 separates from the end 244 of the housing 200, allowing blow-by gases to flow through the PCV valve 116. The position shown in FIG. 2A may correspond to the PCV valve 116 being fully open.

In FIG. 2B, a cross-sectional view illustrates the PCV valve 116 in a closed position. With the spring 208 extended, the flange 212 seals the opening from the crankcase, preventing blow-by gases from venting through the PCV valve 116. While FIGS. 2A and 2B show two positions of the PCV valve 116, the valve may vary between these positions depending on the applied pressure difference.

Referring now to both FIGS. 2A and 2B, a first wire 216 and a second wire 220 connect to the PCV valve 116 from the PCV module 112. The wires 216 and 220 enter the PCV valve 116 through a two-conductor port 228, which defines an opening of the housing 200. To better seal the PCV valve 116, the two-conductor port 228 may be a hermetic seal, including external terminals for the wires 216 and 220 and corresponding internal terminals for connection to the spring 208, with fully encased conductor electrically connecting the respective terminals. The second wire 220 extends through a center of the plunger 204, as shown by dashed line 224, and connects to the second end 236 of the spring 208. The first wire 216 connects to a first end 232 of the spring 208.

A mechanical stop 248 is located on the shoulder 240 of the housing 200 to hold the first end 232 of the spring 208 and prevent the spring 208 from rotating. The mechanical stop 248 may also be the mounting point for the first wire 216 to electrically connect to the spring 208. The stop (not shown) may similarly be present on the flange 212 to retain the second end 236 of the spring 208 and further arrest rotation of the spring 208. The mechanical stop 248 may be a raised detent, a pocket, a weld, or a solder joint.

Figure 3B:
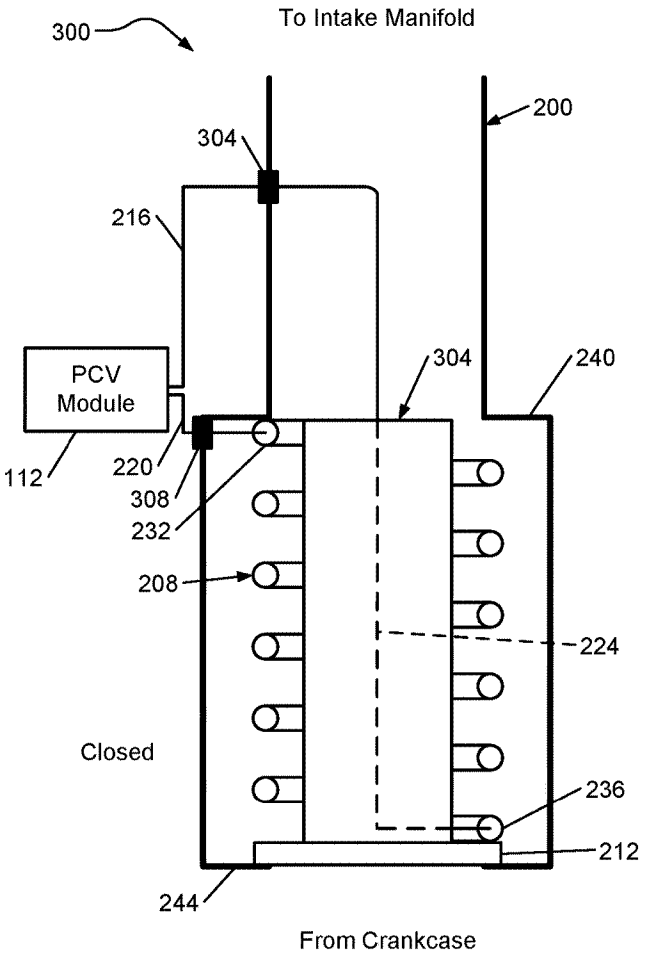
FIG. 3B is a cross-sectional view illustrating another implementation of the PCV valve in a closed position.
Figure 3A:
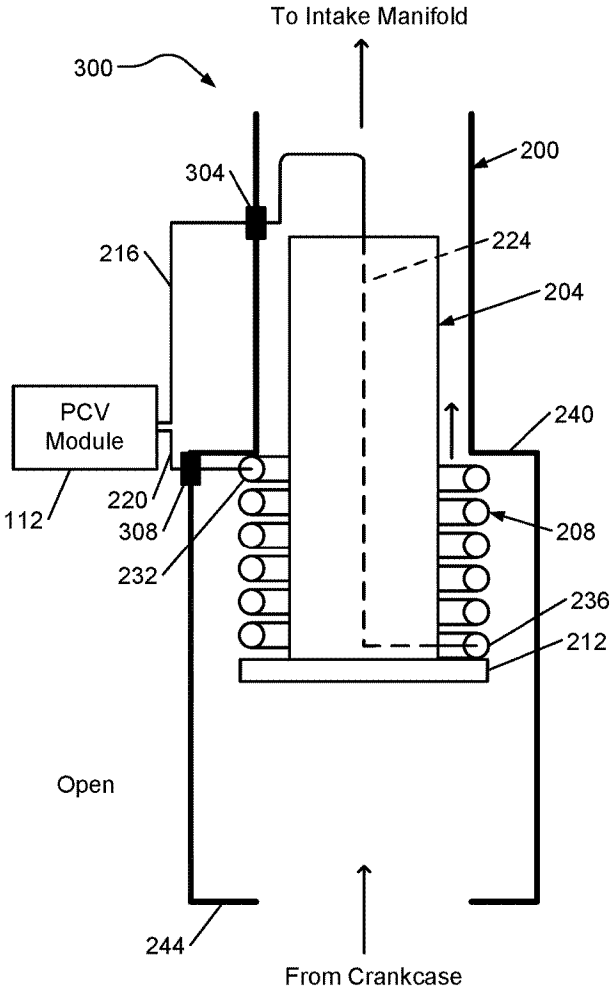
FIG. 3A is a cross-sectional view illustrating another implementation of the PCV valve in an open position.

Referring to FIG. 3A and FIG. 3B, another implementation of a PCV valve 300 is shown in open and closed positions, respectively. The first wire 216 and the second wire 220 connect to the PCV valve 116 from the PCV module 112. In the present implementation, the first wire 216 enters the PCV valve 116 through a first one-conductor port 304 defining a first opening of the housing 200. The second wire 220 enters the PCV valve 116 through a second one-conductor port 308 defining a second opening of the housing 200. This alternative implementation allows the wires 216 and 220 to enter the housing 200 of the PCV valve at separate locations that may be more desirable, such as by allowing each wire easier attachment to its respective end of the spring 208.

Figure 4:
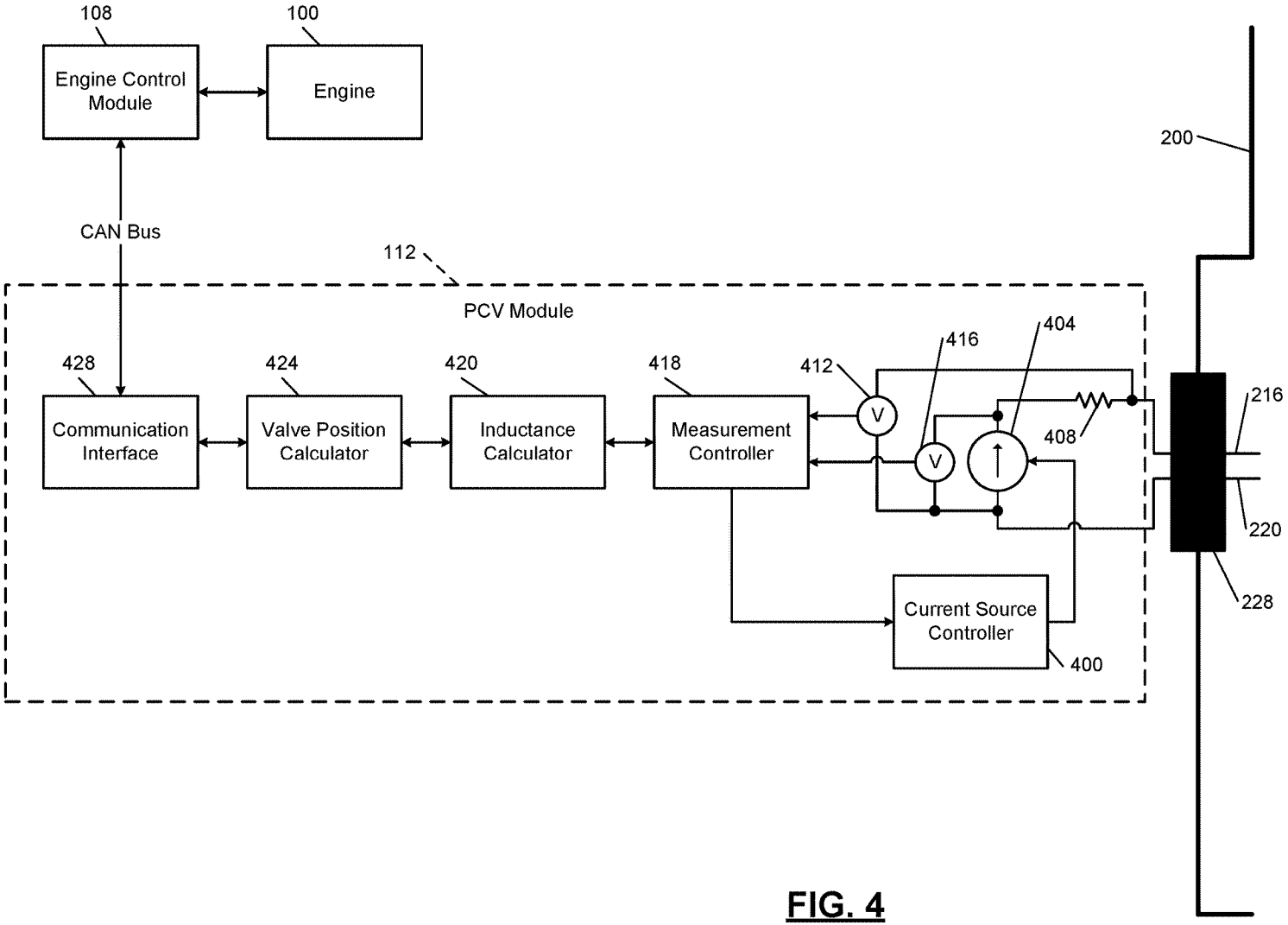
FIG. 4 is a functional block diagram of an implementation of a PCV module.

In FIG. 4, an example implementation of the PCV module 112 implements a circuit for measuring the inductance of the spring 208. Specifically, the PCV module 112 includes a current source 404, a series resistance such as a resistor 408, a first voltage monitor 412, and a second voltage monitor 416. In addition, the PCV module 112 includes a current source controller 400, a measurement controller 418, an inductance calculator 420, a valve position calculator 424, and a communication interface 428. While one inductance measurement technique is shown for illustration, there are multiple other circuit configurations and methods for measuring the inductance of a wire.

Figure 5:
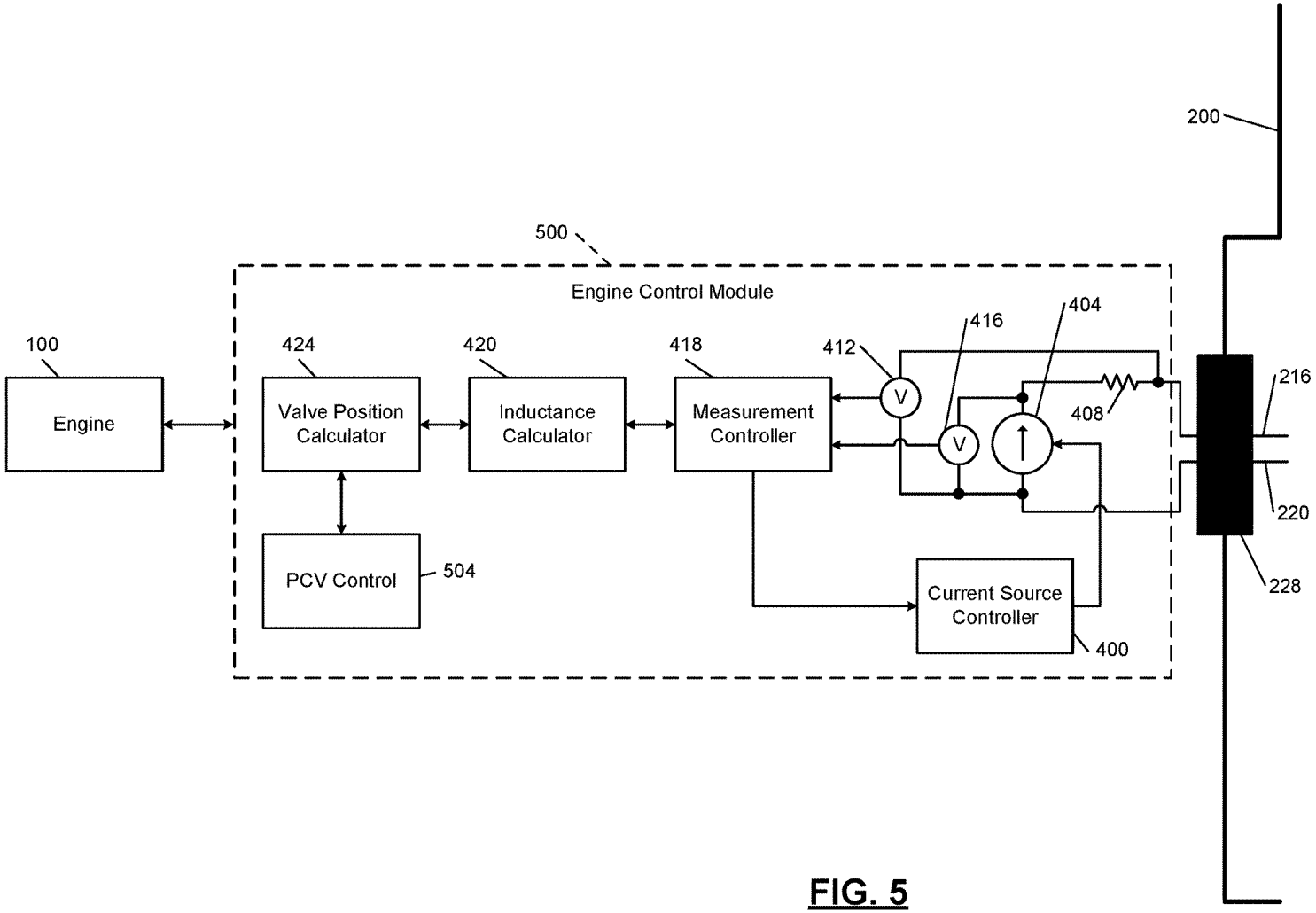
FIG. 5 is a functional block diagram of an implementation of a PCV module integrated with an engine control module.

In FIG. 5, the PCV valve 112 is shown with the first wire 216 and the second wire 220, which connect to the first end 232 of the spring 208 and the second end 236 of the spring 208, respectively. The wires 216 and 220 extend through the two-conductor port 228 in the housing 200 of the PCV valve 116 to the PCV module 112. Within the PCV module 112, the first wire 216 connects to a resistor 408. The resistor 408 connects to a first terminal of the current source 404. The second wire 220 connects to a second terminal of the current source 404, which may be at system ground or earth ground.

The resistor 408 may be physically located within the PCV module 112, as shown in FIG. 4; however, the resistor 408 could be within the PCV valve 116. It may be more desirable to have the resistor 408 within the PCV module 112 to avoid changes in resistance caused by temperature changes in the PCV valve 116.

An electrical source, such as the current source 404, applies an electrical bias, such as alternating current, to the circuit. The current source controller 400 controls the current source 404, including starting and stopping the current applied through the circuit as well as adjusting the frequency of the current source 404.

The first voltage monitor 412 measures the voltage of the terminal between the resistor 408 and the spring 208 with respect to ground—that is, the voltage across the spring 208. In various other implementations, the first voltage monitor 412 may measure the voltage across the resistor 408. The second voltage monitor 416 measures the voltage across the current source 404.

The measurement controller 418 receives voltage data from the voltage monitors 412 and 416 and controls the current source controller 400. The measurement controller 418, as described further in FIGS. 7 and 8, can adjust the frequency of the current source 404 until the voltage across the spring 208 (or, equivalently, across the resistor 408) is half of the voltage across the current source 404.

The following equation can then be used by the inductance calculator 420 to calculate inductance when the voltage ratio is one to two:

$$L = \frac{R\sqrt{3}}{2\pi f} \tag{1}$$

The frequency of the current source 404 may have been provided to the current source controller 400 via a digital or analog command. The frequency used in equation (1) may then simply be the commanded frequency. In other implementations, the frequency used in equation (1) may be measured, such as by the second voltage monitor 416.

Other implementations may use different circuit configurations as well as methods or equations for calculating inductance. For example, the PCV module 112 could measure the inductance of the spring 208 in a circuit including a current sense resistor in series with the spring 208. In this implementation, the electrical bias would be a voltage applied across the spring 208 at a known frequency. Using a monitor to measure the peak current, the inductance could be calculated using the following equation:

$$L = \frac{v * \left(\frac{1}{f}\right)}{I} \tag{2}$$

Using another circuit configuration and method of calculating inductance, the PCV module 112 could measure the inductance of the spring 208 in a circuit including a resistor in series with the spring 208 as well as a capacitor in parallel with the spring 208. In this implementation, the electrical bias would be a voltage applied across the spring 208. A frequency sweep across the terminal connecting the resistor, capacitor, and spring 208 could be used to determine the resonant frequency of the circuit. The inductance may be calculated from the resonant frequency using the following equation:

$$L = \frac{1}{(2\pi f)^2 * C} \tag{3}$$

Once inductance is calculated, the valve position calculator 424 can determine the position of the valve by calculating the length (l) of the spring. The valve position calculator 424 uses the inversely proportional relationship between the inductance of a spring and the length of the spring to determine valve position, as shown in the following equation:

$$L = \frac{N^2 \mu_r \mu_0 A}{l} \tag{4}$$

The inductance of the spring is calculated from equation (1), equation (2), equation (3), or another method of calculating inductance. The number of coils in the spring (N), the cross sectional area of the spring (A), the permeability of the plunger ($\mu_r$), and the permeability constant ($\mu_0$) are all constant, known values or constant values that can be empirically determined.

The length (l) of the spring is indicative of the amount the spring 208 is extended or compressed, indicating the position of the plunger 204. The position of the plunger 204 defines whether the PCV valve 116 is open, closed, or some degree of open or closed. Therefore, the valve position is known once the length (l) of the spring is calculated. Then, the valve position calculator 424 communicates the valve position to the ECM 108 using the communication interface 428, which may communicate using a controller area network (CAN) bus. As further described in FIG. 6, the ECM 108 may be programmed to address faults detected in the PCV valve 116 based on the measured position of the PCV valve 116 differing from the expected position.

In FIG. 5, PCV position testing is integrated with an ECM 500. FIG. 5 demonstrates the same method of calculating the inductance of the spring 208 as in FIG. 4, but with the components incorporated into the ECM 500. In other words, the wires 216 and 220 of the PCV valve 116 are directly connected with the ECM 500, and the ECM 500 performs the measurements, adjustments, and calculations necessary for determining the inductance across the spring, including control methods disclosed in FIGS. 5-7. PCV control 504 uses the measured valve position to detect potential faults within the PCV valve, as described in FIG. 6.

In various alternative implementations, instead of calculating spring length or valve position, either in the PCV module 112 in FIG. 4 or in the ECM 500 in FIG. 5, PCV control 504 could directly compare the measured inductance of the spring to an expected inductance of the spring. The expected inductance of the spring could be determined using similar methods to determining an expected valve position as discussed in detail below, e.g., a lookup table.

Further, to eliminate calculating inductance in the circuits in FIG. 4 and FIG. 5, control could directly use the frequency at which the voltage across the spring equals half of the voltage across the current source. The reference or expected valve position values, which may be determined empirically, would then be specified as frequencies, rather than valve positions. This comparison of frequency may reduce the number of calculations.

Figure 6:
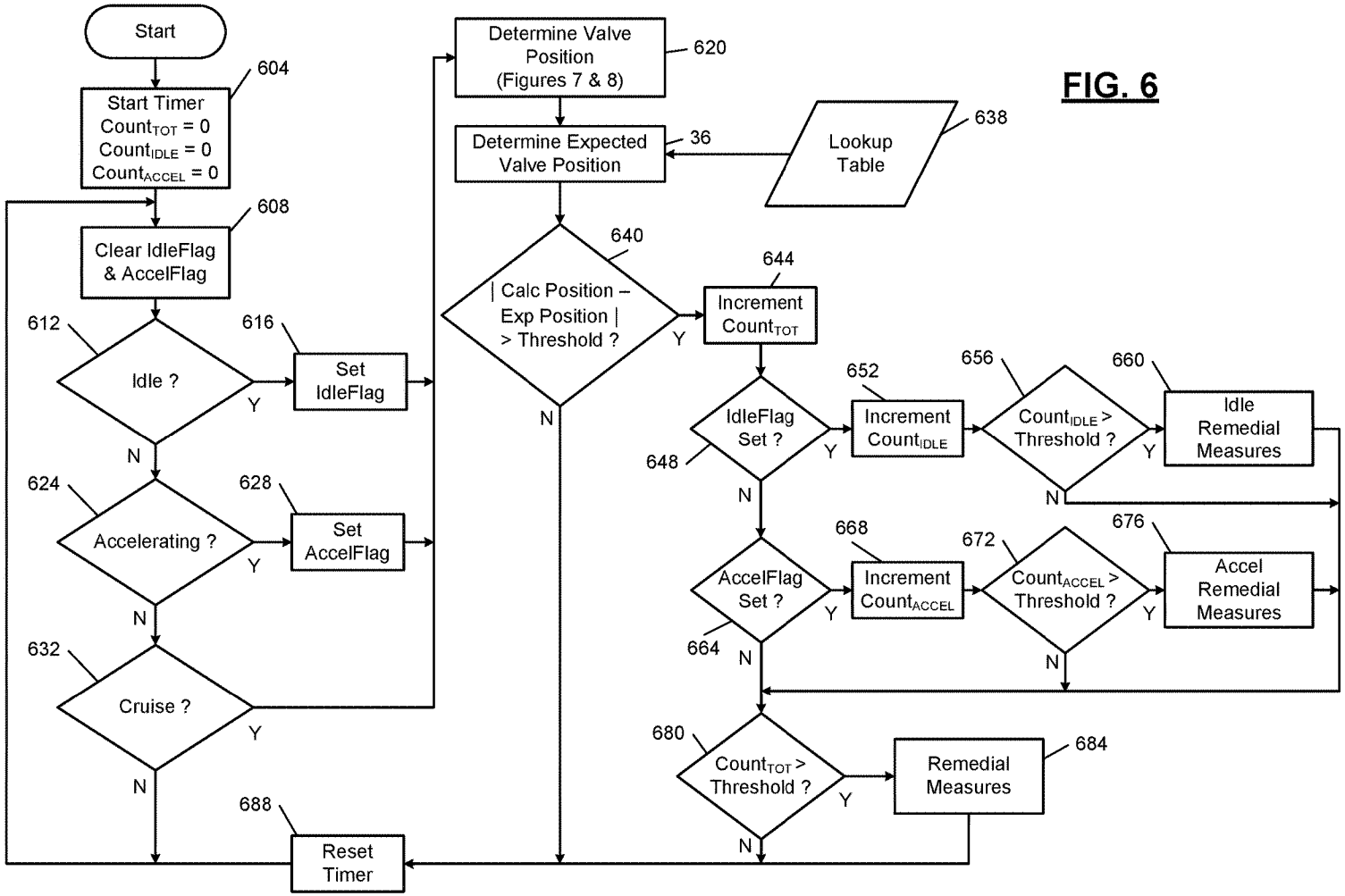
FIG. 6 is a flowchart depicting an example operation of the PCV module.

In FIG. 6, a flowchart depicts example operation of the PCV module. In brief, PCV valve position is calculated at 620 and compared to an expected PCV valve position at 640 under three conditions: when the engine is idle 612, when the engine is accelerating 624, and when the engine is in cruise mode 632. In other implementations, the PCV module 112 could calculate valve position continuously, or according to any other vehicle conditions or time requirements.

Valve position may be calculated when the engine is idle 612 or accelerating 624 as these conditions may have well-characterized expected valve positions. When the engine is idle 612 there is a higher manifold vacuum resulting in a higher pressure differential between the intake manifold and crankcase; therefore, it is expected that the PCV valve 116 will be in a more open position, with the spring compressed as shown in FIG. 2A. Conversely, when accelerating 624 there is a lower manifold vacuum resulting in a lower pressure differential between the intake manifold and crankcase; therefore, it is expected that the PCV valve 116 will be in a more closed position, with the spring extended as shown in FIG. 2B.

Control begins at 604, where the timer starts and counters $Count_{TOT}$, $Count_{IDLE}$, and $Count_{ACCEL}$ are set to zero. IdleFlag and AccelFlag are cleared 608. In response to the engine being idle at 612, control sets the IdleFlag at 616 and then transfers to 620 to determine valve position.

For example only, the engine may be considered to be in an idle state based on input from the TPS, AFR sensor, MAP sensor, engine speed sensor, etc. For example, the engine may be considered to be idling if the engine speed is remaining relatively unchanged over a predetermined period of time, the AFR is at stoich, and the throttle position is a predetermined amount open.

If the engine is not idle at 612, control ascertains if the engine is accelerating at 624. For example, using the TPS and engine speed sensors, the engine may be determined to be accelerating in response to the throttle position being beyond a predetermined amount open and the change in engine speed over a predetermined period of time being above a threshold. In response to the engine accelerating at 624, control sets the AccelFlag at 628 and transfers to 620 to determine valve position.

If the engine is not accelerating at 624, control transfers to 632 to determine if the engine is in cruise mode. If so, control transfers to 620. The engine may be determined to be in cruise mode in response to the engine speed having remained relatively unchanged for a predetermined period of time and the timer has exceeded a second predetermined period, such as 30 seconds. The timer started in 604 represents the amount of time since the valve position was last calculated. Otherwise, if the engine speed does not remain relatively constant or the timer does not exceed the second predetermined period, control returns to 608. In another alternative implementation, a fourth decision box could replace decision box 632 or be placed subsequent to decision box 632, where the fourth decision box specifies that control transfers to 620 in response to the timer exceeding the second predetermined period.

Figure 7:
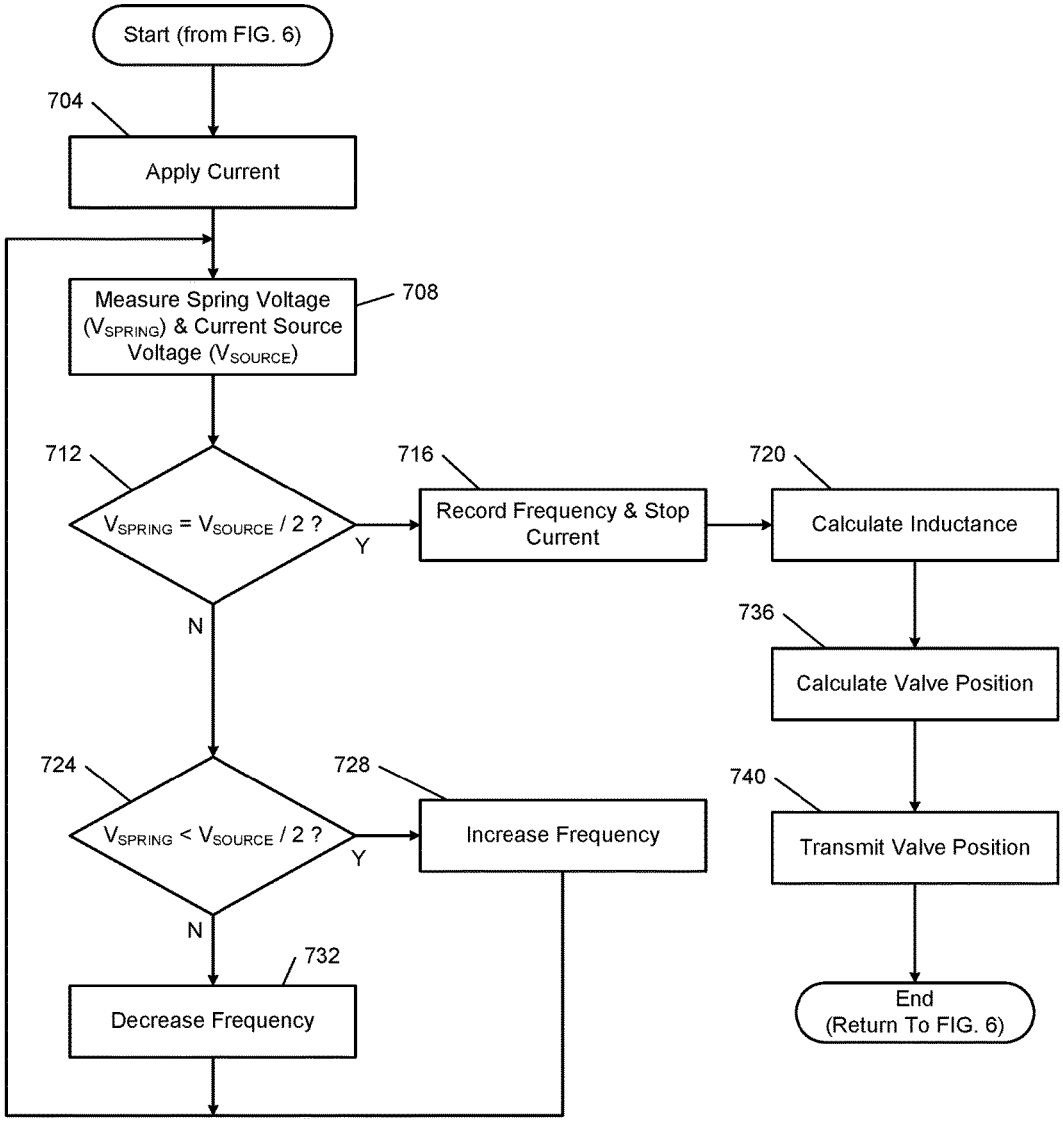
FIG. 7 is a flowchart depicting implementation of PCV module control.
Figure 8:
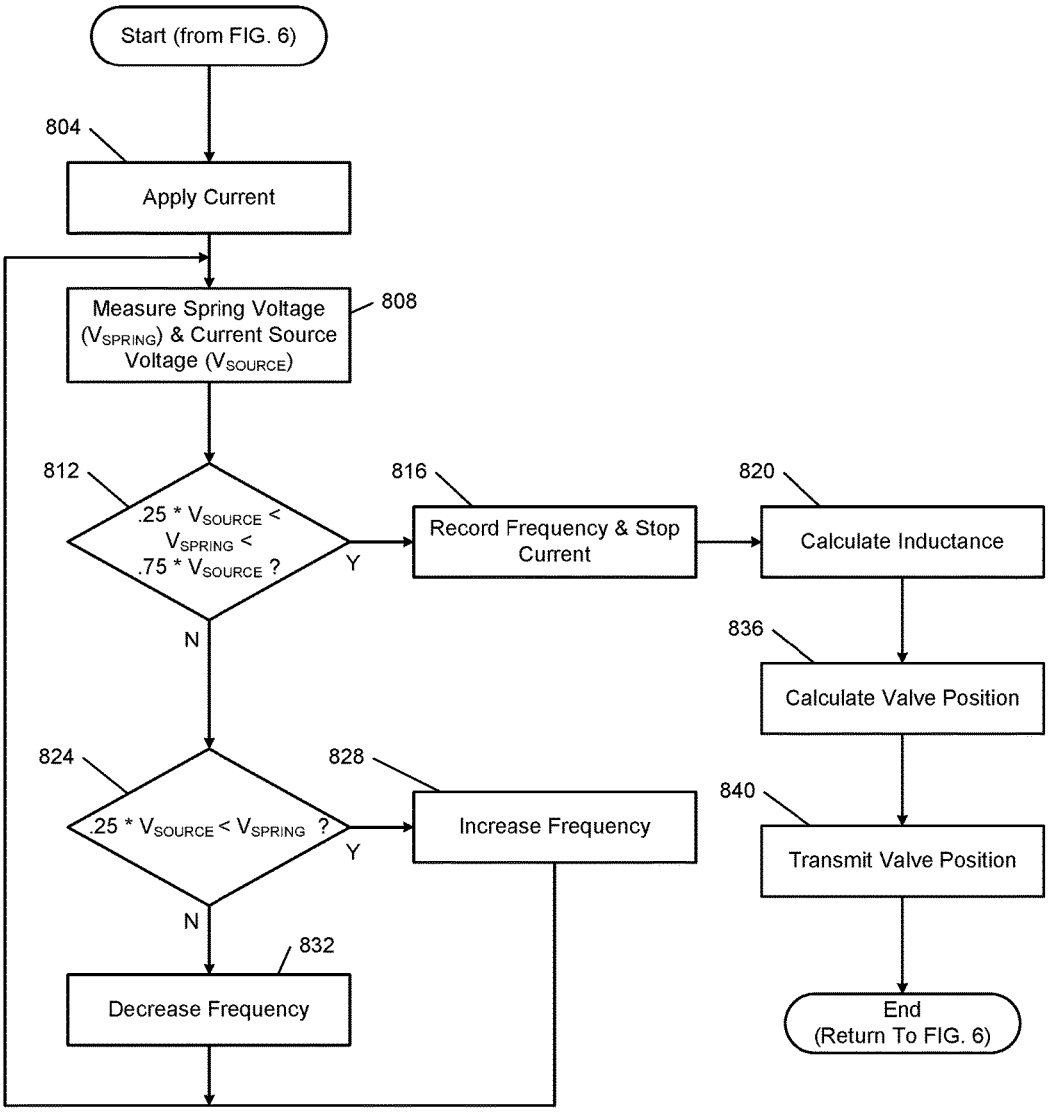
FIG. 8 is a flowchart depicting another implementation of PCV module control.

At 620, the valve position is determined, such as is shown in FIGS. 7 and 8. Control then determines the expected valve position at 636. Control may reference a lookup table 638 to determine the expected position of the valve. The lookup table 638 may be indexed by values of sensors already in the vehicle or engine 100—for example, the MAP sensor. As discussed above, the position of the PCV valve 116 is based on vacuum in the intake manifold 104 and pressure in the crankcase of the engine 100; consequently, values from the MAP sensor may indicate the expected position of the PCV valve 116.

Alternatively, control might determine the expected position of the valve based on whether the engine is idle or accelerating. For example, the expected valve position could depend on whether the IdleFlag or the AccelFlag has been set. As discussed above, the PCV valve 116 is expected to be more open while the engine is idle and more closed while the engine is accelerating.

Once the expected valve position is determined, using any of the above methods, control transfers to 640. In response to the absolute value of the difference between the calculated valve position and the expected valve position being greater than a predetermined threshold at 640, $Count_{TOT}$ is incremented at 644; otherwise control resets the timer at 688 and returns to 608. When the difference between the calculated and expected valve position exceeds the predetermined threshold, the PCV valve is not in the expected position; therefore, a fault has occurred.

$Count_{TOT}$ tracks a total number of faults—that is, times the PCV valve 116 differs from the expected position by at least the predetermined threshold amount. Maintaining $Count_{TOT}$ allows control to perform remedial measures after one fault occurs or after the number of faults that occur exceeds a fault threshold. $Count_{TOT}$ includes all faults that occur in the PCV valve 116, whether the faults occur when the engine is idle, accelerating, or in cruise mode.

After $Count_{TOT}$ is incremented at 644, control transfers to 648. In response to IdleFlag being set, $Count_{IDLE}$ is incremented at 652. $Count_{IDLE}$ tracks the number of faults or times the PCV valve 116 is not in the expected position by the predetermined threshold amount while the engine is idle. Control may then perform different remedial measures or use separate control strategies if a certain number of faults occur while the engine is idle. In response to $Count_{IDLE}$ exceeding an idle fault threshold at 656, control could perform idle remedial measures 660.

These idle remedial measures could include control strategies particularly directed toward the PCV valve 116 remaining in the closed position when the expected valve position is some degree of open. This distinction, between faults occurring when the valve is stuck open or closed, may help further diagnose malfunctions or leaks in the PCV valve. After performing idle remedial measures 660 or if the idle fault threshold is not exceeded at 656, control continues to 680.

Returning to 648, if the IdleFlag has not been set, control continues to 664. In response to the AccelFlag being set at 664, $Count_{ACCEL}$ is incremented at 668. Similar to $Count_{IDLE}$, $Count_{ACCEL}$ allows for separate accelerating remedial measures and control strategies for the PCV valve 116 when the engine is accelerating and the valve remains in the open position when the expected position is closed. If $Count_{ACCEL}$ exceeds a certain accelerating fault threshold at 672, then control may perform accelerating remedial measures at 676.

Similar to idle remedial measures, accelerating remedial measures provides a distinction between appropriate remedies when the valve is stuck in the open position versus stuck in the closed position. After performing accelerating remedial measures at 676, if the accelerating fault threshold is not exceeded at 672, or if the AccelFlag was not set, control continues to 680.

At 680, in response to $Count_{TOT}$ exceeding a total fault threshold, control performs remedial measures at 684. Remedial measures may include illuminating the malfunction indicator lamp, cylinder activation or deactivation, adjusting the air to fuel ratio, etc. After performing remedial measures at 684, control resets the timer at 688 and returns to 608.

In FIG. 7, a flowchart depicts an example inductance calculation method, which may be called by FIG. 6. Control begins at 704 where the current source 404 applies a current to the spring 208. As discussed above, in other implementations the electrical bias, i.e., current, applied to the spring does not have to be current. For example, the circuit could include a voltage source that applies a voltage across the spring.

Using equation 1 to calculate inductance, a frequency of the current source applied across the spring is recorded. In the present implementation, the frequency to record is the frequency used to calculate inductance in equation 1. This is the frequency when the voltage ratio is one to two, i.e., when the voltage across the spring is equal to half of the voltage across the current source. In alternative implementations, an algorithm could use the voltage measurements to calculate the inductance using another equation.

It is important to note, however, that when calculating inductance, the frequency used in equation 1 may be the frequency when the voltage across the spring approximately equals half of the voltage across the current source. This depends on the degree of particularity of the PCV module 112. In other words, the degree to which the voltage across the spring matches half of the voltage across the current source 712 could be within a certain tolerance.

For example only, the absolute value of the difference between the voltage across the spring and half of the voltage across the current source could be used to determine the tolerance. This tolerance may only require the difference to be within a certain threshold amount or within a certain percentage.

In another implementation, control could consider the amount by which the frequency is incremented, e.g., increased at 728 or decreased at 732, to reach the frequency of the one to two voltage ratio. Depending on how control increments the frequency, the frequencies applied to the circuit could straddle the frequency where the voltage ratio is one to two, never reaching that frequency. For example, if the amount the frequency is incremented results in the voltage across the spring being too low and, after the frequency is incremented, the voltage across the spring being too high, control could choose to use either frequency or an interpolated frequency in between the two frequencies as the frequency for inductance calculation.

After the current is begun to be applied at 704, the voltage across the spring and the voltage across the current source are measured at 708. To calculate inductance of the spring, the frequency of the current source is used to solve for inductance of the spring 208 as shown by equation 1. Once there is a voltage ratio of one to two, i.e., the voltage across the spring equals half of the voltage across the current source at 712, the current source is applying the frequency used to solve for inductance. Therefore, in response to the voltage across the spring equaling half of the voltage across the current source 712, the frequency is recorded and used to calculate inductance, and the current is stopped at 716.

If the voltage across the spring does not equal half of the voltage across the current source at 712, control transfers to 724. In response to the voltage across the spring being less than half of the voltage across the current source at 724, the current source controller 400 increases the frequency at 728 by a predetermined increment amount; otherwise, the current source controller 400 decreases frequency at 732 by the predetermined increment amount. Control then returns to measure the voltage across the spring and the voltage across the current source at 708 at the new frequency. The frequency is increased at 728 or decreased at 732 incrementally until the current source is applying the frequency used to solve for inductance—that is, the voltage across the spring matches, or approximately matches, half of the voltage across the current source at 712.

At 716, the frequency is recorded, and the current is stopped. The inductance of the spring is calculated at 720, such as according to equation 1. In other implementations, where the current or resonant frequency is measured, the inductance of the spring would be calculated at 720 using equation 2 or equation 3, respectively.

Once inductance is calculated at 720, the valve position is calculated at 736 according to equation 4. As the length of the spring is inversely proportional to the inductance of the spring, the valve position can be determined from the calculated inductance using this principle as expressed in equation 4. In other words, the length—i.e., compression or extension—of the spring equates to the valve position. Once the valve position is calculated at 736, the valve position is transmitted at 740, and control in FIG. 7 ends.

In other implementations, instead of using equation 4, control could determine the valve position at 736 by accessing a lookup table indexed by the inductance across the spring.

In FIG. 8, a flowchart depicts another implementation of inductance calculation, which may be called by FIG. 6. Control begins at 804, where the current source 404 applies a current to the spring 208. Voltage is measured at 808 across the spring 208 and across the current source 404. In response to the voltage across the spring being between one-quarter and three-quarters of the voltage across the current source at 812, the frequency is recorded and the current stopped at 816. This frequency is more flexible than the frequency in FIG. 7 that is used to calculate the inductance. The method shown in FIG. 8 involves potentially fewer frequency increments, potentially obtaining a less accurate frequency at the voltage ratio of one to two (the voltage ratio used in equation 1), but the result is the inductance is calculated more quickly.

If the voltage across the spring is not between one-quarter of the voltage across the current source and three-quarters of the voltage across the current source at 812 creating a voltage ratio between one-to-four and three-to-four, control transfers to 824. In response to one-quarter of the voltage across the current source being less than the voltage across the spring at 824, the current source controller 400 increases the frequency at 828; otherwise, the current source controller 400 decreases the frequency at 832. Control then returns to measure the voltage across the spring and the voltage across the current source at 808 at the new frequency. The frequency is incremented to adjust the voltage across the spring to be between one-quarter and three-quarters of the voltage across the current source. The frequency is increased at 828 or decreased at 832 incrementally until the voltage ratio is between one to four and three to four.

At 816, the frequency is recorded and the current stopped. The inductance of the spring is calculated at 820 by solving the following equation for L.

$$\frac{V_{SPRING}}{V_{SOURCE}} = \frac{\omega L}{\sqrt{R^2 + \omega^2 L^2}} \tag{5}$$

where $\omega = 2\pi f$.

At 836, the valve position is calculated using equation 4. Once the valve position is calculated at 836, the valve position is transmitted at 840. Control then ends. In other implementations, instead of using equation 4, control could determine the valve position at 836 by accessing a lookup table indexed by the inductance across the spring 208.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C." The term "resistor" can be a component including a wire that results in a resistance.

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The apparatuses and methods described in this application may be partially or fully implemented by a special purpose computer created by configuring a general purpose computer to execute one or more particular functions embodied in computer programs. The functional blocks and flowchart elements described above serve as software specifications, which can be translated into the computer programs by the routine work of a skilled technician or programmer.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

What is claimed is:

1. A sensor circuit for a positive crankcase ventilation (PCV) valve of an engine, the sensor circuit comprising:

an electrical source configured to apply an electrical bias across a spring of the PCV valve, wherein the electrical bias is applied between a first end of the spring and an opposite end of the spring;

a measuring circuit configured to measure a value of an electrical parameter of the spring while the electrical bias is applied, wherein the electrical parameter indicates at least one of (i) a voltage across the spring and (ii) a current through the spring;

a position calculator configured to calculate an inductance of the spring based on the value of the electrical parameter and calculate a position of the PCV valve based on the inductance;

a transmitter configured to output a signal that indicates the position of the PCV valve;

a resistor connected in series between the electrical source and the spring;

the electrical parameter indicates the voltage across the spring; and the position calculator is configured to (i) adjust a frequency of the electrical source until a voltage across the spring is approximately equal to one-half of the voltage across the electrical source and (ii) calculate the inductance of the spring based on the frequency and a value of the resistor.

2. An assembly comprising:

the sensor circuit of claim 1; and the PCV valve, wherein the PCV valve comprises a plunger configured to move between (i) an open state that allows blow-by gases to flow from a crankcase of the engine to an intake manifold of the engine and (ii) a closed state that stops the flow of blow-by gases, and wherein the spring biases the plunger to the closed state.

3. The assembly of claim 2 further comprising:

a two-conductor port defining an opening in a housing of the PCV valve, wherein the two-conductor port is configured to electrically connect to the sensor circuit on an exterior of the housing, and wherein the two-conductor port is configured to electrically connect to the first end of the spring and the opposite end of the spring in an interior of the housing.

4. A system comprising:

the sensor circuit of claim 1; and an engine control module (ECM) configured to:

receive the signal, including the position of the PCV valve, from the transmitter;

determine an expected position of the PCV valve; and selectively perform a remedial action in response to a difference between the expected position of the PCV valve and the received position of the PCV valve exceeding a threshold.

5. The system of claim 4 wherein the ECM is configured to (i) receive a value from a manifold absolute pressure (MAP) sensor and (ii) determine, based on the value from the MAP sensor, the expected position of the PCV valve.

6. The system of claim 4 wherein the ECM is configured to determine the expected position of the PCV valve from a lookup table based on a value from a sensor.

7. The system of claim 4 wherein the remedial action includes illuminating a malfunction indicator lamp.

8. The system of claim 4 wherein the ECM is configured to:

increment a count each time the difference between the expected position of the PCV valve and the received position of the PCV valve exceeds the threshold; and selectively perform a remedial action in response to the count exceeding a predetermined threshold.

9. The system of claim 4 wherein the electrical source is configured to apply the electrical bias and the measuring circuit is configured to measure the value of the electrical parameter in response to at least one of:

the engine reaching an idle mode, wherein the idle mode corresponds to a minimum opening of a throttle valve of the engine;

the engine entering an acceleration mode, wherein the acceleration mode corresponds to an opening of the throttle valve being greater than a predetermined value; and a predetermined period elapsing since a last measurement of the value of the electrical parameter.

10. The system of claim 9 wherein the ECM is configured to:

in response to the difference between the expected position of the PCV valve and the received position of the PCV valve exceeding the threshold:

if the engine is in the idle mode, increment an idle count; and if the engine is in the acceleration mode, increment an acceleration count;

in response to the idle count exceeding a first predetermined threshold, perform the remedial action based on a stuck closed failure mode of the PCV valve; and in response to the acceleration count exceeding a second predetermined threshold, perform the remedial action based on a stuck open failure mode of the PCV valve.

11. A method for sensing a position of a positive crankcase ventilation (PCV) valve of an engine comprising:

applying an electrical bias with an electrical source across a spring of a PCV valve, wherein the electrical bias is applied between a first end of the spring and an opposite end of the spring;

measuring a value of an electrical parameter of the spring while applying the electrical bias, wherein the electrical parameter indicates at least one of (i) a voltage across the spring and (ii) a current through the spring;

calculating an inductance of the spring based on the value of the electrical parameter and calculating a position of the PCV valve based on the inductance;

transmitting an output signal indicating the position of the PCV valve;

using a resistor connected in series between the electrical source and the spring;

indicating the voltage across the spring with the electrical parameter;

adjusting a frequency of the electrical source until a voltage across the spring is approximately equal to one-half of the voltage across the electrical source; and calculating the inductance of the spring based on the frequency and a value of the resistor.

12. The method of claim 11 further comprising:

receiving the output signal, including the position of the PCV valve;

determining an expected position of the PCV valve; and selectively performing a remedial action in response to a difference between the expected position of the PCV valve and the received position of the PCV valve exceeding a threshold.

13. The method of claim 12 further comprising:

receiving a value from a manifold absolute pressure (MAP) sensor; and determining, based on the value from the MAP sensor, the expected position of the PCV valve.

14. The method of claim 12 further comprising determining the expected position of the PCV valve from a lookup table based on a value from a sensor.

15. The method of claim 12 wherein the remedial action is illuminating a malfunction indicator lamp.

16. The method of claim 12 further comprising:

maintaining a count of occurrences of the difference between the expected position of the PCV valve and the received position of the PCV valve exceeding a threshold; and selectively performing the remedial action in response to the count of occurrences exceeding a predetermined threshold.

17. The method of claim 12 further comprising applying the electrical bias with the electrical source and measuring the value of the electrical parameter in response to at least one of:

the engine reaching an idle mode, wherein the idle mode corresponds to a minimum opening of a throttle valve of the engine;

the engine entering an acceleration mode, wherein the acceleration mode corresponds to an opening of the throttle valve being greater than a predetermined value; and a predetermined period elapsing since a last measurement of the value of the electrical parameter.

18. The method of claim 17 further comprising:

in response to the difference between the expected position of the PCV valve and the received position of the PCV valve exceeding the threshold:

incrementing an idle count if the engine is in the idle mode; and incrementing an acceleration count if the engine is in the acceleration mode; and in response to the idle count exceeding a first predetermined threshold, performing the remedial action based on a stuck open failure mode of the PCV valve; and in response to the acceleration count exceeding a second predetermined threshold, performing the remedial action based on a stuck closed failure mode of the PCV valve.

19. A sensor circuit for a positive crankcase ventilation (PCV) valve of an engine, the sensor circuit comprising:

an electrical source configured to apply an electrical bias across a spring of the PCV valve, wherein the electrical bias is applied between a first end of the spring and an opposite end of the spring;

a measuring circuit configured to measure a value of an electrical parameter of the spring while the electrical bias is applied, wherein the electrical parameter indicates at least one of (i) a voltage across the spring and (ii) a current through the spring;

a position calculator configured to calculate an inductance of the spring based on the value of the electrical parameter and calculate a position of the PCV valve based on the inductance;

a transmitter configured to output a signal that indicates the position of the PCV valve;

an engine control module (ECM) configured to:

receive the signal, including the position of the PCV valve, from the transmitter;

determine an expected position of the PCV valve;

selectively perform a remedial action in response to a difference between the expected position of the PCV valve and the received position of the PCV valve exceeding a threshold;

receive a value from a manifold absolute pressure (MAP) sensor; and determine, based on the value from the MAP sensor, the expected position of the PCV valve.

20. A sensor circuit for a positive crankcase ventilation (PCV) valve of an engine, the sensor circuit comprising:

an electrical source configured to apply an electrical bias across a spring of the PCV valve, wherein the electrical bias is applied between a first end of the spring and an opposite end of the spring;

a measuring circuit configured to measure a value of an electrical parameter of the spring while the electrical bias is applied, wherein the electrical parameter indicates at least one of (i) a voltage across the spring and (ii) a current through the spring;

a position calculator configured to calculate an inductance of the spring based on the value of the electrical parameter and calculate a position of the PCV valve based on the inductance;

a transmitter configured to output a signal that indicates the position of the PCV valve;

an engine control module (ECM) configured to:

receive the signal, including the position of the PCV valve, from the transmitter;

determine an expected position of the PCV valve;

selectively perform a remedial action in response to a difference between the expected position of the PCV valve and the received position of the PCV valve exceeding a threshold; and determine the expected position of the PCV valve from a lookup table based on a value from a sensor.

* * * * *